US006611238B1

(12) United States Patent
Santoru et al.

(10) Patent No.: US 6,611,238 B1
(45) Date of Patent: Aug. 26, 2003

(54) METHOD AND APPARATUS FOR REDUCING EARTH STATION INTERFERENCE FROM NON-GSO AND TERRESTRIAL SOURCES

(75) Inventors: Joseph Santoru, Agoura Hillis, CA (US); Ernest C. Chen, San Pedro, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 3 days.

(21) Appl. No.: 09/992,992

(22) Filed: Nov. 6, 2001

(51) Int. Cl.[7] ..... H01Q 13/00

(52) U.S. Cl. ..... 343/840; 343/786

(58) Field of Search ..... 343/840, 786, 343/781, 837, 781 R

(56) References Cited

U.S. PATENT DOCUMENTS

| | | | | |
|---|---|---|---|---|
| 3,176,301 A | | 3/1965 | Wellons et al. | 343/782 |
| 3,430,244 A | | 2/1969 | Bartlett et al. | 343/755 |
| 3,706,999 A | | 12/1972 | Tocquec et al. | 343/782 |
| 3,936,837 A | * | 2/1976 | Coleman et al. | 343/781 |
| 4,263,599 A | | 4/1981 | Bielli et al. | 343/781 R |
| 4,380,014 A | | 4/1983 | Howard | 343/786 |
| 4,660,045 A | | 4/1987 | Clark | 342/361 |
| 4,803,495 A | | 2/1989 | Monser et al. | 343/777 |
| 5,187,491 A | | 2/1993 | Schuss et al. | 343/781 R |
| 5,317,328 A | * | 5/1994 | Allen | 343/786 |
| 5,422,913 A | | 6/1995 | Wilkinson | 375/347 |
| 5,483,663 A | | 1/1996 | Tawil | 455/3.2 |
| 5,625,640 A | | 4/1997 | Palmer et al. | 375/202 |
| 5,761,605 A | | 6/1998 | Tawil et al. | 455/3.2 |
| 5,870,439 A | | 2/1999 | Ben-Efraim et al. | 375/202 |
| 5,905,474 A | | 5/1999 | Ngai et al. | 343/840 |
| 5,955,783 A | | 9/1999 | Ben-Efraim et al. | 257/728 |
| 5,959,590 A | | 9/1999 | Sanford et al. | 343/784 CA |
| 5,959,592 A | | 9/1999 | Petruzzelli | 343/840 |
| 6,041,224 A | | 3/2000 | Wada | 455/327 |
| 6,091,931 A | | 7/2000 | Ben-Efraim et al. | 455/3.2 |
| 6,134,282 A | | 10/2000 | Ben-Efraim et al. | 375/350 |
| 6,208,834 B1 | | 3/2001 | Tawil et al. | 455/312 |

(List continued on next page.)

FOREIGN PATENT DOCUMENTS

EP 1083720 A2 3/2001

OTHER PUBLICATIONS

Rizzi, Peter A., *Microwave Engineering, Passive Circuits*, Prentice Hall, title page and pp. 229–234.

Berrou et al., *Near Shannon Limit Error–Correcting Coding and Decoding: Turbo–Codes*(1), in Proc. ICC'93, Geneva, Switzerland, May 1993, pp. 1064–1070.

Before the Federal Communications Commission, In the Matter of: Amendment of Parts 2 and 25 of the Commission's Rules to Permit Operation of NGSO FSS Systems Co–Frequency with GSO and Terrestrial Systems in the Ku–Band Frequency Range; Amendment of the Commision's Rules to Authorize Subsidiary Terrestrial Use of the 12.2–12.7 GHz Band by Direct Broadcast Satellite Licensees and their Affiliates; and Applications of Broadwave USA, PDC Broadband Corporation, and Satellite Receivers, Ltd. to Provide A Fixed Service in the 12.2–12.7 GHz Band Comments of AT&T Corp., Mar. 12, 2001, 24 pages.

*Primary Examiner*—James Clinger
(74) *Attorney, Agent, or Firm*—John A. Crook; Michael W. Sales

(57) ABSTRACT

An apparatus for reducing earth station interference in a receiver antenna from non-GSO and terrestrial sources is disclosed. The apparatus comprises an absorber coupled to a receiver antenna feed assembly disposed between the non-GSO or terrestrial source and the feed assembly. Embodiments are disclosed in which the absorber is strategically placed where it minimally affects the receiver antenna mainlobe performance, while reducing interference from non-GSO and terrestrial sources.

36 Claims, 12 Drawing Sheets

U.S. PATENT DOCUMENTS

| | | | | |
|---|---|---|---|---|
| 6,353,490 | B1 | 3/2002 | Singer et al. | 359/145 |
| 2001/0019942 | A1 | 9/2001 | Tawil et al. | 455/13.1 |
| 2002/0016157 | A1 | 2/2002 | Arsenault et al. | 455/226.3 |
| 2002/0025005 | A1 | 2/2002 | Onggosanusi et al. | 375/295 |
| 2002/0032908 | A1 | 3/2002 | Booth | 725/86 |

* cited by examiner

METHOD AND APPARATUS FOR REDUCING EARTH STATION INTERFERENCE FROM NON-GSO AND TERRESTRIAL SOURCES

CROSS-REFERENCE TO RELATED APPLICATIONS

This application is related to the following co-pending and commonly assigned patent application, which application is incorporated by reference herein:

Application Ser. No. 09/480,089, entitled "METHOD AND APPARATUS FOR MITIGATING INTERFERENCE FROM TERRESTRIAL BROADCASTS SHARING THE SAME CHANNEL WITH SATELLITE BROADCASTS USING AN ANTENNA WITH POSTERIOR SIDELOBES," filed on Jan. 10, 2000, by Paul R. Anderson, attorney's docket number PD-990074.

BACKGROUND OF THE INVENTION

1. Field of the Invention

The present invention relates to systems and methods receiving broadcast signals, and in particular to a system and method for receiving satellite broadcasts while reducing interference from terrestrial sources or from satellite sources such as nongeostationary fixed satellite service networks.

2. Description of the Related Art

It has been proposed to cooperatively share the current Broadcasting-Satellite Service (BSS) frequency bands to allow additional programming material to be transmitted to BSS users or subscribers using the same frequency bands as currently used by BSS satellites. This may be implemented through the use of non-geostationary orbit (GSO) and/or terrestrially-based transmitters to transmit the additional programming. Such systems typically rely on spatial diversity to minimize the probability of interference. This usually requires a BSS satellite ground antenna having highly directional, monocular sensitivity characteristics in order to realize low interference levels.

Unfortunately, existing BSS antennae do not exhibit a highly directional sensitivity characteristic. Instead, as described in application Ser. No. 09/480,089, entitled "METHOD AND APPARATUS FOR MITIGATING INTERFERENCE FROM TERRESTRIAL BROADCASTS SHARING THE SAME CHANNEL WITH SATELLITE BROADCASTS USING AN ANTENNA WITH POSTERIOR SIDELOBES," which application is hereby incorporated by reference, existing BSS antennae exhibit a sensitivity characteristic that includes substantial sensitivity in a rearward direction. They also exhibit a sensitivity characteristics in the sideward and upward directions. This sensitivity can result in substantial interference between transmissions from BSS satellites and transmissions from non-GSO or terrestrial sources.

U.S. Pat. No. 3,430,244, issued to H. E. Barlett et al. discloses a transmitting reflector antenna. The transmitting antenna includes a solid dielectric guiding structure imposed between the feed and the reflector. The dielectric surface acts as a lens to direct the radiation emanating from the feed at the reflector surface. Because the incident angle of the electromagnetic energy from the phase center of the horn to the lens is at a small angle, the electromagnetic energy is largely reflected. If not for the lens, the electromagnetic energy would emanate from the phase center of the horn and continue beyond and behind the reflector surface, thus creating spillover. While this design reduces spillover, this design requires use of an expensive dielectric structure extending from the horn to the reflector surface, thus complicating installation, and requires a modified reflector surface in order to direct the rays where required. The design can also result in significant phase distortion.

U.S. Pat. No. 3,176,301 issued to R. S. Wellons et al. discloses an antenna design having multiple feeds. A cylindrical metallic shield is placed on the periphery of the reflector and a second cylindrical metallic shield is placed surrounding the feeds to reduce spillover. While this design can reduce spillover, the metallic surface permits reflections within the shield itself, potentially compromising the spillover reduction, and permitting distortion of the received signal. The reflections within the metallic shield are also made worse because the shield itself is distant from each of the horns. Further, the metallic shield is not easily attached to the assembly of horns.

U.S. Pat. No. 3,706,999, issued to Tocquec et al. discloses a Cassegraninan antenna with a design that is said to reduce spillover energy. However, exising BSS antennae are simple offset reflector designs and cannot be easily modified in accordance with the disclosed Cassegranian design.

U.S. Pat. No. 4,263,599, issued to Bielli et al. discloses a parabolic reflector antenna having a reflector periphery lined with absorbent material to reduce spillover. While design reduces spillover, it requires the use of a substantial amount of absorbent material.

U.S. Pat. No. 4,380,014, issued to Howard, U.S. Pat. No. 4,803,495, issued to Monser et al., U.S. Pat. No. 5,905,474 issued to Nagi et al., and U.S. Pat. No. 5,959,590 issued to Sanford et al. each disclose designs which reduce spillover. However, in each case, the design disclosed is not one that can be obtained with simple modification of existing BSS antennae.

What is needed is an inexpensive, but effective way to modify the sensitivity characteristic of existing BSS antennae to reduce the interference from non-GSO and terrestrial broadcast sources. The present invention satisfies this need.

SUMMARY OF THE INVENTION

To address the requirements described above, the present invention discloses an antenna for receiving electromagnetic energy from a first transmitter and substantially rejecting electromagnetic energy from a second transmitter spatially diverse from the first transmitter. The antenna comprises a reflector having a reflecting surface for reflecting and focusing the electromagnetic energy from the first transmitter to at least one focal point; a feed assembly for receiving the reflected electromagnetic energy, the feed assembly having a sensitive axis facing the reflecting surface wherein the feed assembly and the reflector together define a spillover region bounded by a feed assembly beamwidth extending from the sensitive axis at least partially beyond the reflector surface; and an electromagnetic energy absorber, attached to the feed assembly and disposed at least partially between the spillover region and the feed assembly. The present invention is also described by a method of receiving electromagnetic energy from a first transmitter and substantially rejecting electromagnetic energy from a second transmitter spatially diverse from the first transmitter. The method comprises the steps of receiving electromagnetic energy from the first transmitter reflected by a reflector surface in a feed assembly, the feed assembly and reflective surface together defining a spillover region defined by a feed assembly beamwidth extending from a feed assembly sensitive axis at least partially beyond the reflector surface; and absorbing the electromagnetic energy from the second transmitter with an absorber coupled to the feed assembly and disposed at least partially between the spillover region and the feed assembly.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1:
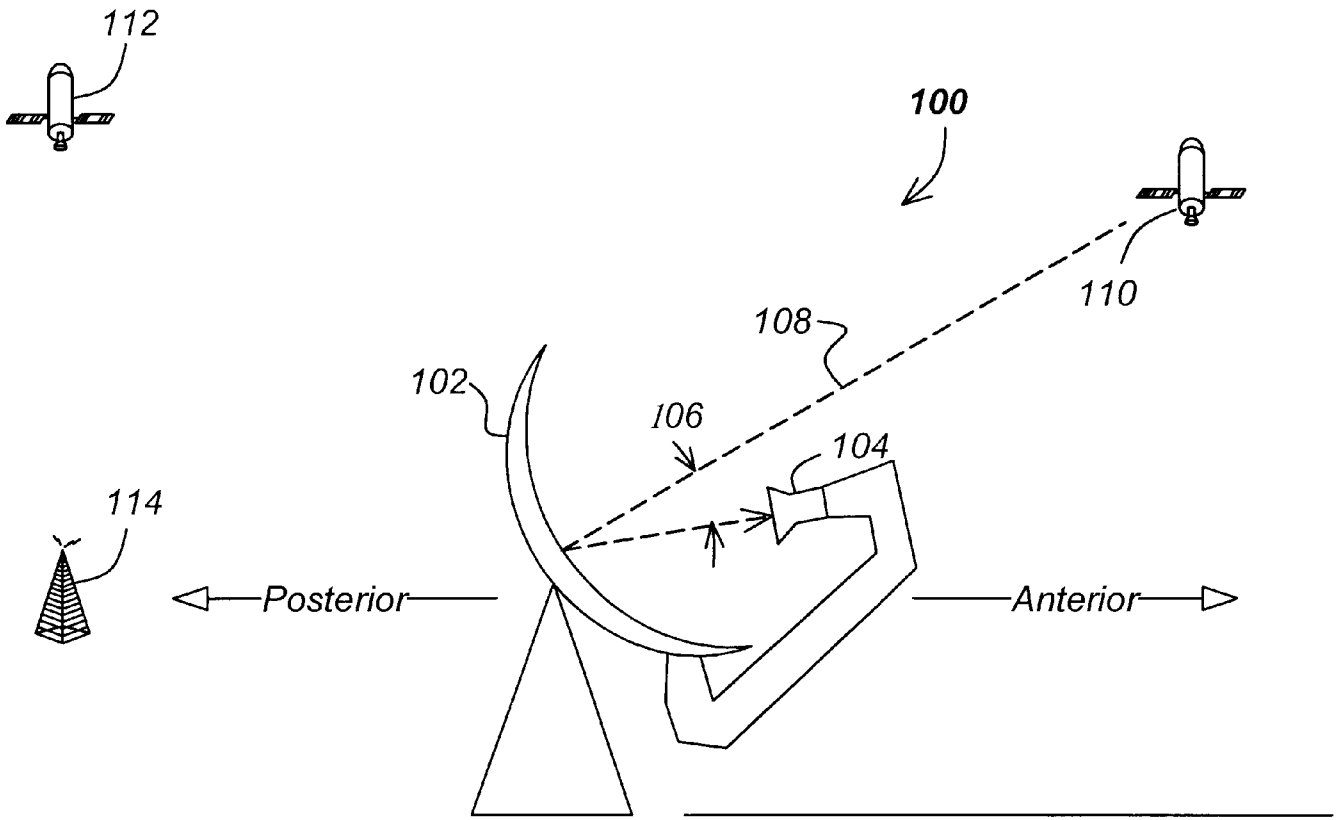
FIG. 1 is a diagram showing one embodiment of a satellite receive antenna.

FIG. 1 is a diagram of one embodiment of satellite receive antenna 100 configured to receive transmissions from BSS satellites. The satellite receive antenna 100 includes a reflector 102, which reflects and focuses the energy from the satellite transmitter 110 on a means for receiving the signal from the BSS satellite (e.g. a feed 104 such as a low noise block converter (LNB)) disposed at an angle (in one embodiment, 22.5 degrees) 106 from the centerline 108 of the reflector 102. This angle positions the LNB 104 out of the way to minimize attenuation of the incoming signal along the antenna centerline or boresight. In one embodiment, the reflector 102 may be parabolic with a slightly ovoid shape to account for the offset in LNB 104 position.

The polar sensitivity characteristic of the satellite receive antenna 100 is a function of a number of interrelated physical and electrical antenna characteristics. These characteristics include, among other things, the sensitivity characteristics and physical location of the LNB 104 relative to the reflector 102, and the shape of the surface of the reflector 102.

For example, the LNB 104 may be disposed closer to the surface of the reflector 102, but the focus of the parabolic reflector 102 (and hence its external surface contour) must be changed to account for this modified LNB 104 location. Further, the beamwidth along the sensitive axis of the LNB 104 must be modified to achieve the desired antenna sensitivity. Similarly, the LNB 104 may be placed farther away from the reflector 102, and other antenna 100 parameters must be modified to reflect this difference.

To maximize the antenna sensitivity along its centerline 108, it is desirable that the beamwidth of the sensitive axis of the LNB 104 be wide enough to accept signals from as much of the reflector 102 surface as possible, including the outer periphery. At the same time, if the beamwidth of the LNB 104 is too wide (exceeding the periphery of the reflector 102), spillover signals from a non-GSO satellite 112 or a terrestrial transmitter 114 from behind the reflector 102 can be received by the LNB 104. In such cases, the sensitivity characteristic of the antenna 100 will include sidelobes in the posterior (rear) side of the antenna 100 having a significant sensitivity.

Figure 2A:
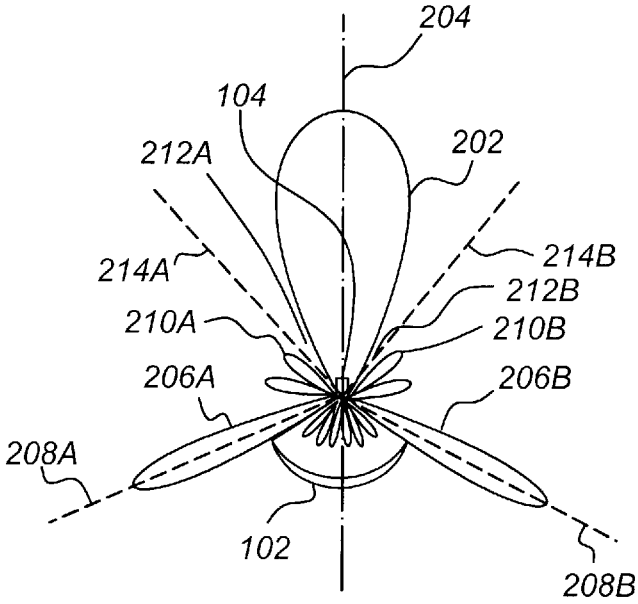
FIGS. 2*a–b* is a diagrams showing a sensitivity characteristic of a representative satellite receive antenna.
Figure 2B:
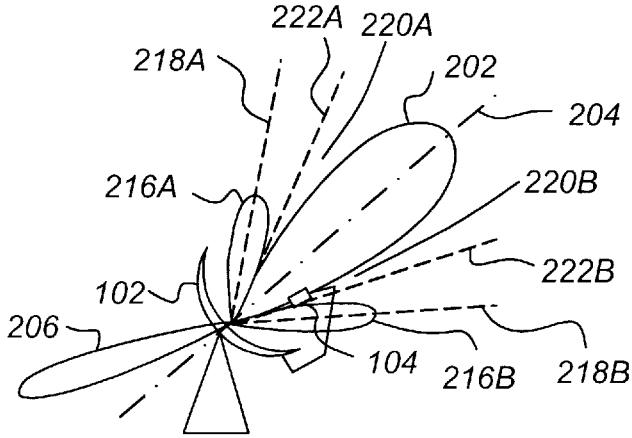

FIGS. 2A and 2B are diagrams depicting the sensitivity characteristic of a representative satellite receive antenna 100. FIG. 2A depicts an azimuthal slice of the antenna characteristic, while FIG. 2B shows a slice along the elevation direction at a zero azimuth angle.

FIG. 2A discloses an azimuthal sensitivity characteristic including an anteriorly-disposed main lobe 202 substantially aligned along a primary sensitive axis 204, and a plurality of sidelobes 210A, 210B, 206A, and 206B. Nulls such as null 212A and null 212B are disposed between the sidelobes 210A, 210B, 206A, and 206B. Nulls 212A and 212B are disposed substantially along null axes 214A and 214B. Posterior sidelobes 206A and 206B are substantially along secondary sensitive axes 208A and 208B, respectively. As described above, the posterior sidelobes 206A and 206B are the result of satellite receive antenna design compromises, resulting, among other things, in spillover from the rear of the reflector 102 to the feed or LNB 104.

FIG. 2B discloses an elevation sensitivity characteristic including the main lobe 202, sidelobes 216A and 216B substantially along sidelobe axes 218A and 218B. Nulls 222A and 222B are disposed along null axes 222A and 222B, respectively, between the main lobe 202 and the sidelobes 216A and 216B, as well as between other sidelobes not illustrated. The depictions of the mainlobe 202 and sidelobes in FIGS. 2A and 2B above are intended to be representative depictions of the polar sensitivity characteristic of a satellite receive antenna 100 by which the present invention may be practiced. The present invention could be practiced with antennae having sensitivity characteristics with different lobes and null patterns with suitable modification.

Figure 3:
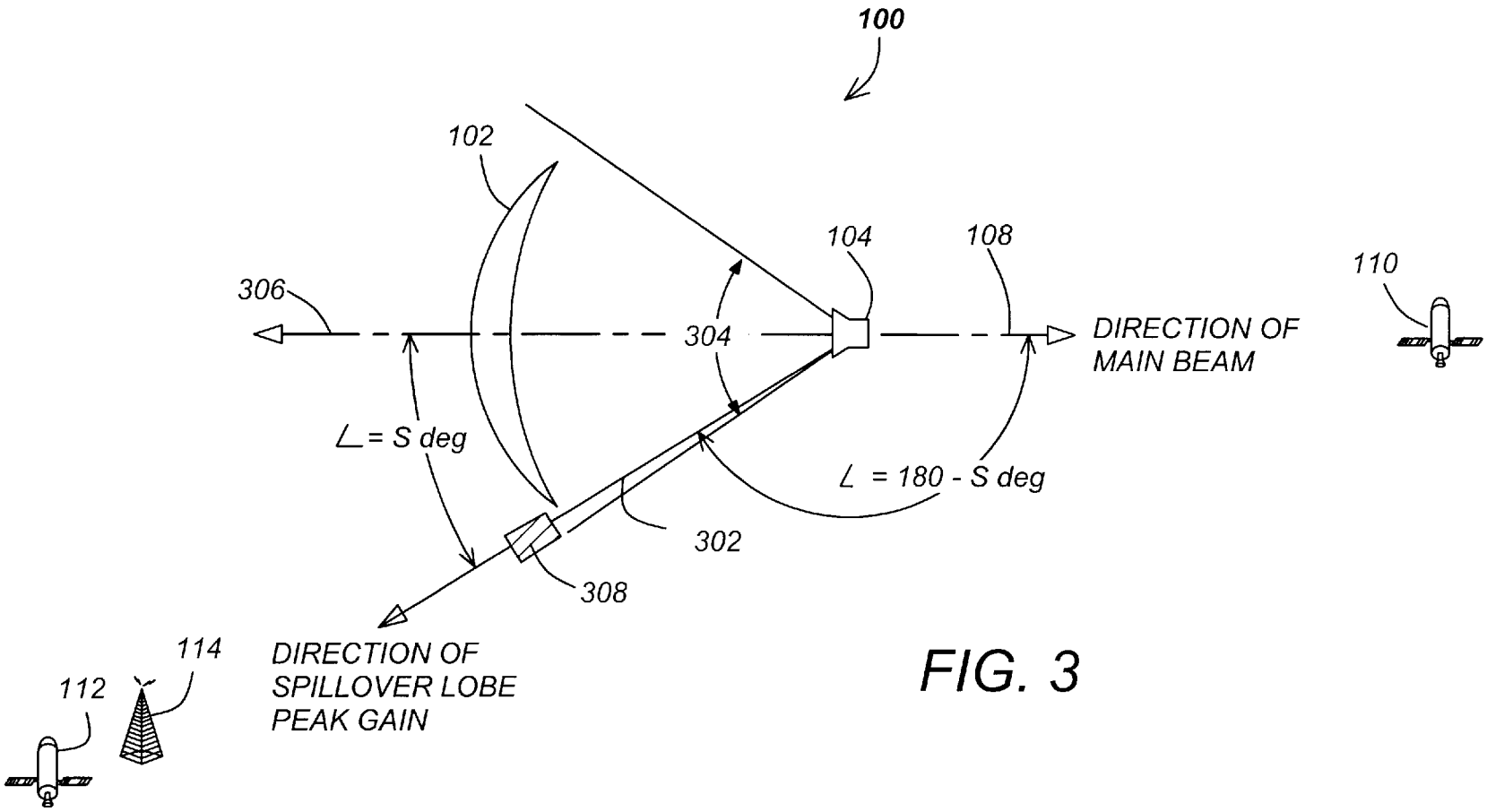
FIG. 3 is a diagram depicting a top view of the satellite receive antenna spillover lobe geometry.

FIG. 3 is a diagram showing the satellite receive antenna spillover lobe geometry. The source of the satellite receive antenna spillover lobes 206A and 206B is the relationship between the beamwidth 304 of the LNB 104 about the LNB sensitive axis 306, the diameter of the reflector 102, and the distance of the LNB 104 from the reflector 102. When the beamwidth 304 of the LNB 104 about the LNB 104 sensitive axis 306 exceeds the diameter of the reflector 102, electromagnetic energy from behind the reflector 102 can be sensed by the LNB 104. This allows the satellite receive antenna 100 to have a gain characteristic with significant posterior lobes 206A and 206B. As shown in FIG. 2, the peak of the posterior side lobe (or spillover lobe 206) is at an angle 180°-S degrees from the satellite receive antenna 100 boresight 108, where S represents the angle (in degrees) between the rear-facing portion of the antenna centerline 206 and the peak of the posterior side lobe 206 in direction 302. The geometry of the reflector 102, feed assembly 104 and the the beamwidth 304 of the feed assembly 104 define a spillover region 308.

Figure 4:
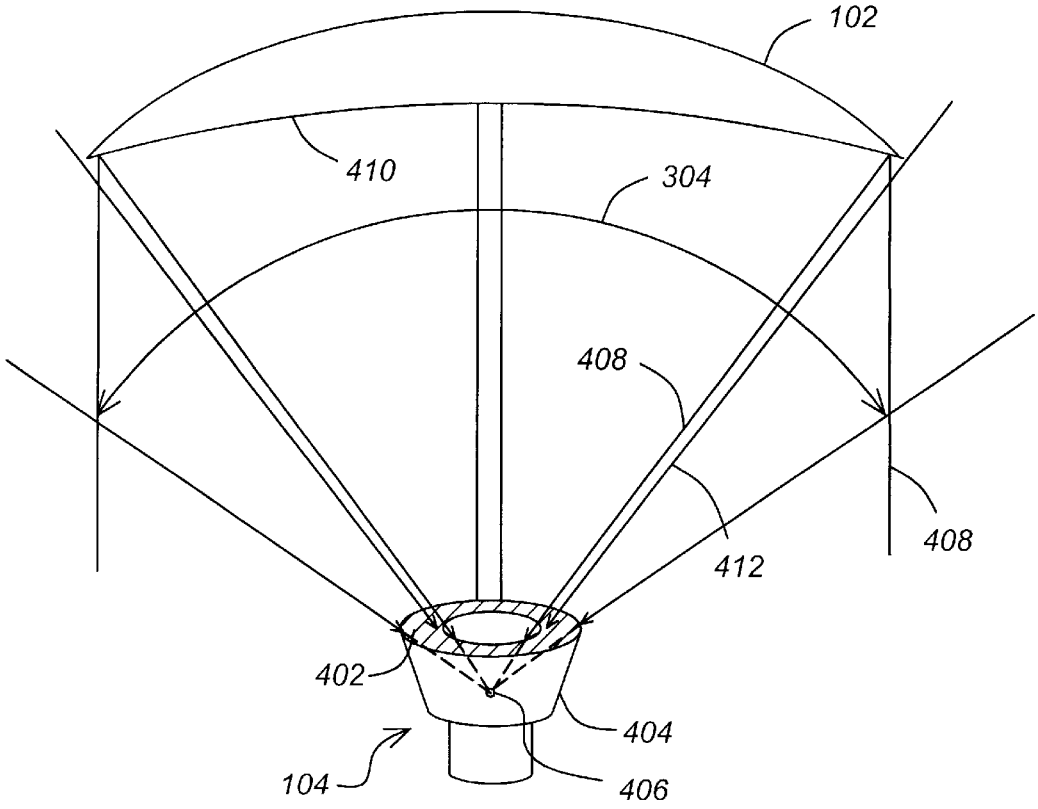
FIG. 4 is a diagram of one embodiment of the present invention in which the absorber is placed within the feed assembly horn.

FIG. 4 is a diagram illustrating one embodiment of the present invention in which an electromagnetic energy absorber 402 is placed within the feed assembly horn. The dimensions of the absorber 402 are determined from the relative geometry of the reflector 102, the feed horn 404, the phase center 406 of the horn 404, and the beamwidth 304 of the feed horn assembly. The dimensions of the absorber 402 are selected so that electromagnetic energy following path 408 (from the intended transmitter (e.g. the satellite 110) to the reflector 102 and reflected towards the feed assembly 104 by the reflective surface 410) is not adversely attenuated or absorbed by the absorber 402 to a significant degree, while electromagnetic energy following path 412 (spillover) is attenuated by the absorber 402.

Figure 5A:
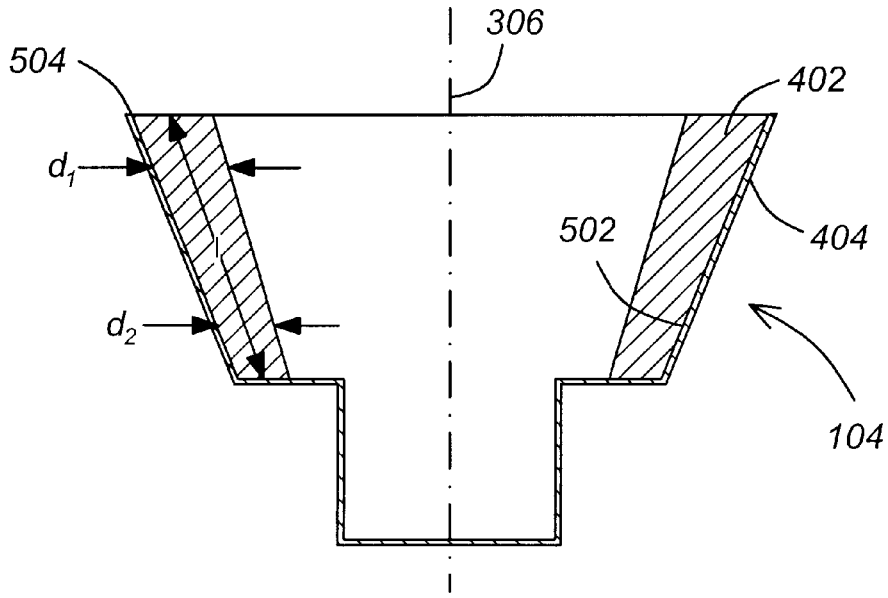
FIGS. 5A–5D are diagrams presenting cross sections of a plurality of embodiments of the present invention.

FIG. 5A is a diagram presenting a cross section of another embodiment of the present invention. In the illustrated embodiment, the absorber 402 is disposed on an inner surface 502 of the horn 404. The absorber 402 can be sized so that the dimension $d_1$ proximate the outer periphery 504 of the horn 404 and the dimension in the inner horn $d_2$ are equal, or different. The insertion of the absorber 402 can change boundary conditions and the sidelobe and mainlobe patterns of the antenna 100, but by judicious selection of dimensions $d_1$ and $d_2$, spillover may be substantially attenuated while allowing the mainlobe to remain effectively unaltered. The absorber 402 need not extend from the outer periphery 504 of the horn 404 to the inner horn. Instead, the length l of the absorber 402 can also be selected to effect a compromise between spillover suppression and mainlobe performance. Unlike dielectric materials which are either transparent or reflective to electromagnetic energy depending on the incident angle of the energy on the surfaces of the dielectric, the absorber 402 illustrated above is substantially opaque at all incident angles.

Figure 5B:
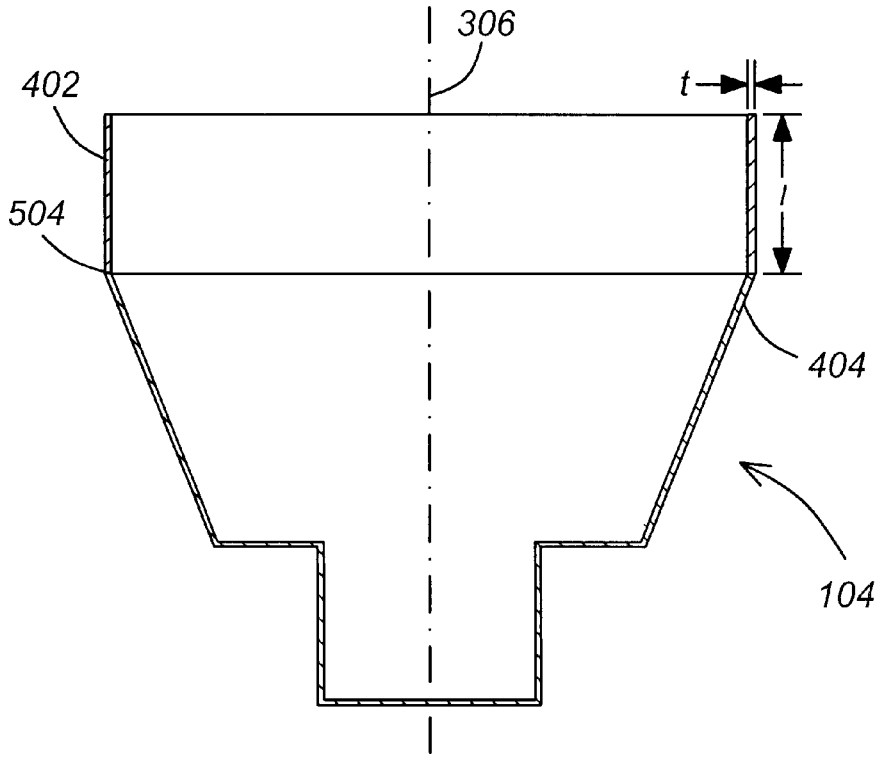

FIG. 5B is a diagram of another embodiment of the present invention in which the absorber 402 is disposed on the feed horn 404 aperture. In this embodiment the absorber 402 is disposed circumferentially on an outer periphery 504 and parallel to the sensitive axis of the feed horn 404. The length l and the thickness t of the absorber 402 can be selected to maximize spillover suppression while minimizing the effect on mainlobe performance. Further, the absorber structure shown in FIG. 5B can be used in combination with the absorber 402 shown in FIG. 5A.

Figure 5C:
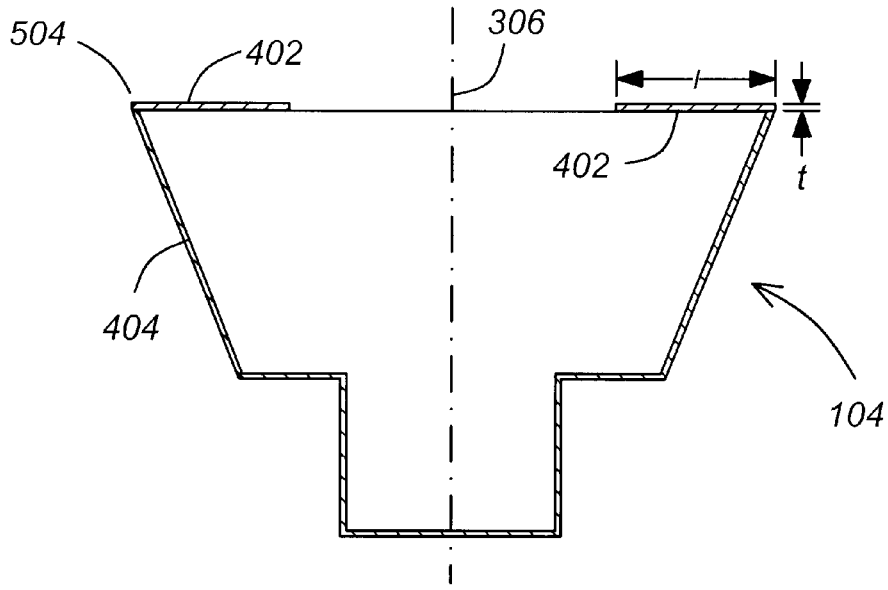

FIG. 5C is a diagram of another embodiment of the present invention. In this embodiment, the absorber 402 is disposed on an outer periphery 504 of the feedhorn 404, however, the absorber is disposed perpendicular to the sensitive axis of the feed horn assembly 104. The dimensions of the absorber 402 (length and thickness) can also be selected to maximize spillover suppression while minimizing any effects on mainlobe performance.

Figure 5D:
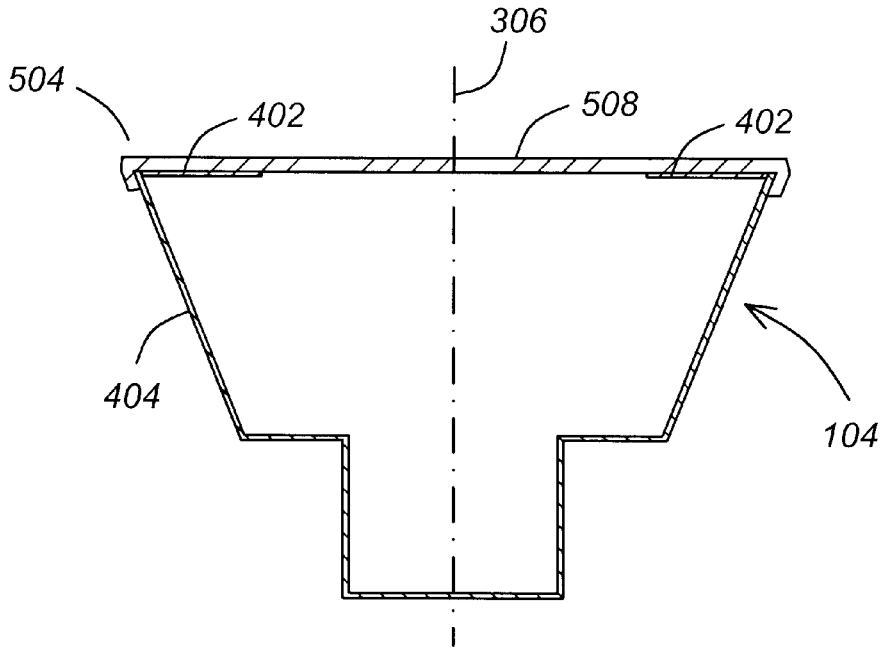

FIG. 5D is a diagram of another embodiment of the present invention. Typically, the feed horn 404 of the present invention is protected by a electromagnetic energy-transparent cap 508. The absorber 402 can be integrated with or attached to the cap 508. In this embodiment, the absorber 402 can be an electromagnetic absorbing paint or an absorbent material. This embodiment has the advantage of not exposing the absorbent material to the atmosphere or the sun (typically, the cap is optically opaque). In an alternative embodiment, the cap 508 remains electromagnetically transparent, but a second cap having the absorber 402 is attached over the cap 508. This cap can be installed as a part of a retrofit kit for the consumer.

It is noted that in embodiments wherein the absorber 402 is asymmetrically disposed (more or less absorbent material on different parts of the cap 508), it may be advantageous to include a reference on the cap so that the absorbent material is oriented properly relative to the reflector 102 and the sources of interfering electromagnetic energy. This reference allows the user to place the cap 508 on the feed horn 404 with the proper rotation angle about the sensitive axis 306.

Figure 6:
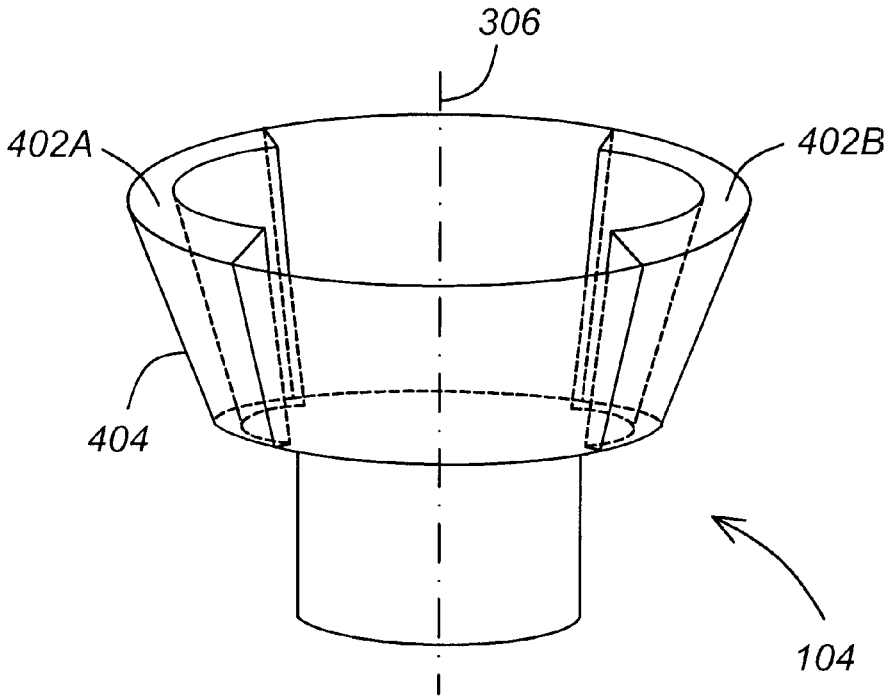
FIG. 6 is a diagram illustrating another embodiment of the present invention wherein the absorber is disposed only where required to prevent interference from a stationary transmitter.

FIG. 6 is a diagram of another embodiment of the present invention wherein the absorber 402 is disposed only between a second (and potentially interfering) transmitter and the feed assembly. This embodiment is particularly useful in situations where spillover is only an issue for substantially stationary transmitters. For example, if spillover allows terrestrially located transmitters to interfere with the reception of electromagnetic energy from a BSS transmitter, the absorbent material need only be placed between these terrestrially located transmitters and the feed horn assembly, and not on the entire feed horn assembly. This embodiment is also particularly useful with reflective antennae that are of an offset feed design, such as those used to receive BSS satellite broadcasts, since the spillover pattern for such antennae are asymmetric (the asymmetric nature of the spillover pattern for such antennae are fully discussed in application Ser. No. 09/480,089, entitled "METHOD AND APPARATUS FOR MITIGATING INTERFERENCE FROM TERRESTRIAL BROADCASTS SHARING THE SAME CHANNEL WITH SATELLITE BROADCASTS USING AN ANTENNA WITH POSTERIOR SIDELOBES.") Although the absorber 402 illustrated in FIG. 6 includes a first portion 402A and a second portion 402B, more portions, or only a single portion may be employed. Further, the shape of the absorber portions 402A and 402B may be modified to account for the transmitting characteristics of the second (and interfering transmitter), and thus, each portion may have different dimensions and be located on different portions of the feed horn 404. Note also that while FIG. 6 illustrates an embodiment where the absorber 402 is placed inside the feed horn 404, this need not be the case. The absorber 402 may be placed exterior to the feed horn 404, as illustrated in FIGS. 5B and 5C, for example.

It is noted that adding the absorber 402 will alter the boundary conditions of the radiation pattern of the antenna 100. Further, the foregoing designs need not completely attenuate the spillover electromagnetic energy. Instead, substantial absorption of the spillover energy (enough to prevent interference), can be obtained while retaining effective mainlobe performance. In the foregoing examples, the absorber 402 can be fashioned from a bulk absorber or from electromagnetic energy absorbing paint. There are a wide variety of commercially available X-band/Ku-band absorbers for such purpose.

The foregoing designs will reduce the sensitivity of the antenna 100. A simple estimate of the percentage of power that will be lost from the radiated beam can be performed.

Figure 7:
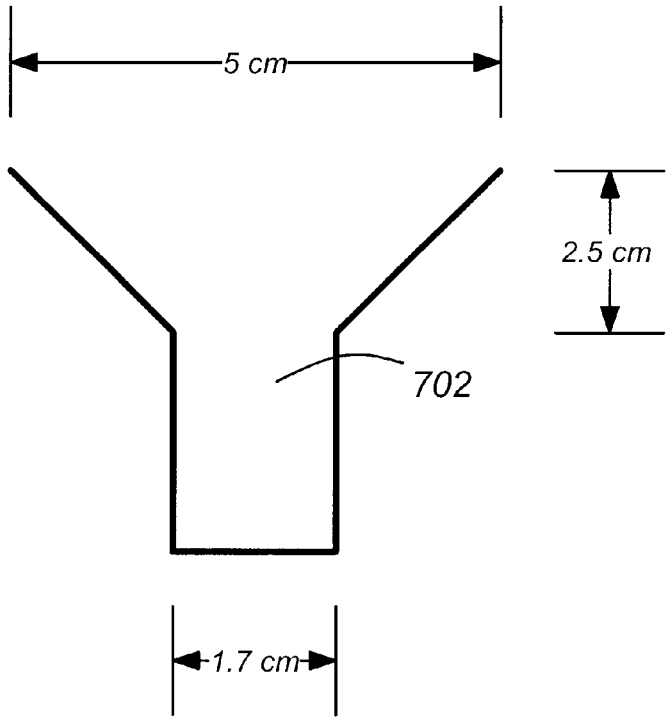
FIG. 7 is a diagram showing typical physical dimensions for a feed assembly.

FIG. 7 is a diagram showing typical physical dimensions of feed assembly (or LNB) 104. From the approximate dimensions of the circular waveguide 702, the mode in the guide is $TE_{11}$, since this is the only TE mode that is not cut off at 12.5 GHz. The radial and azimuthal electric and magnetic fields in a 1.7 centimeter waveguide can be used to calculate the Poynting vector to provide an estimate of the power flowing in the waveguide. For example, see *Microwave Engineering, Passive Circuits,* by Rizzi, pages 233 et seq., which are hereby incorporated by reference. The field components for $TE_{11}$ mode in cylindrical coordinates, can be derived as follows:

$$E_r = -\sqrt{2}\,E_0\frac{\lambda_c}{\lambda_g}\left(\frac{\lambda_c}{2\pi r}\right)J_1\left(\frac{2\pi r}{\lambda_c}\right)\sin\phi\sin(\omega t-\beta z)$$

$$E_\phi = -\sqrt{2}\,E_0\frac{\lambda_c}{\lambda_g}J_1'\left(\frac{2\pi r}{\lambda_c}\right)\cos\phi\sin(\omega t-\beta z)$$

$$H_z = \sqrt{2}\,H_0 J_1\left(\frac{2\pi r}{\lambda_c}\right)\cos\phi\cos(\omega t-\beta z)$$

$$H_r = -\frac{E_\phi}{Z_{TE}}$$

$$H_\phi = \frac{E_r}{Z_{TE}}$$

where $\lambda_c$=1.706D;

D is the diameter of the circular waveguide;

ω is the frequency (radians/sec) of the electromagnetic energy, t is time (sec);

r is the radial variable in cylindrical coordinates;

ϕ is the angular variable in cylindrical coordinates;

z in the axial variable in cylindrical coordinates;

$J_1$ is the first order Bessel Function of the First Kind;

$J_1'$ is the first derivative of $J_1$;

$E_0$ is a scalar whose value depends on the power transmitted through the circular waveguide;

$E_\phi$ is the electric field in the azimuthal direction;

$E_r$ is the electric field in the radial direction,

β is equal to $(\omega^2\mu\in-k_c^2)^{1/2}$;

$k_c$ is equal to $2\pi/\lambda_c$;

μ is the permeability of the air-filled cylindrical waveguide, and is equal to the permeability of free space, $4\pi\times10^{-7}$ Henry/m;

∈ is the permittivity of the air-filled cylindrical waveguide, and is equal to the permittivity of free space, $8.85\times10^{-12}$ Farad/m;

$H_0$ is equal to $E_o/Z_{TE}$;

$Z_{TE}$ is the impedance of the $TE_{11}$ mode in the cylindrical waveguide;

$H_r$ is the magnetic field intensity in the radial direction;

$H_\phi$ is the magnetic field intensity in the azimuthal direction;

$H_z$ is the magnetic field intensity in the axial direction;

$\lambda_g=\lambda_0[1-(\lambda_0/\lambda_c)^2]^{-0.5}$;

$\lambda_0$ is the free space electromagnetic wavelength at the frequency of interest; and radial, axial and azimuthal directions are as defined for a cylindrical coordinate system.

Forming the cross product of E and H yields the z-component of the Poynting vector, which has a value of $$\frac{E_r^2+E_\phi^2}{Z_{TE}}$$

in the z direction (i.e., out of the waveguide).

Using the equations above, the Poynting vector can be simplified to $$f(\phi,r)=\alpha[(k_c r)^{-2}(J_1(k_c r))^2\sin^2(\phi)+(J_1'(k_c r))^2\cos^2(\phi)],$$

where $$k_c=2\pi/\lambda_c$$

and

α is a constant that does not depend on r or ϕ.

Integrating the expression for power flux density over the unblocked aperture (in terms of coordinates r and ϕ) allows the power flux across different portions of the waveguide aperture to be estimated.

For a waveguide diameter of 1.7 cm, approximately 11% of the power would be affected by a ring of absorbing material 0.1 cm wide around the outer edge of the waveguide aperture. Interestingly, the reduction in the cross-sectional area of the waveguide (from a diameter of 1.7 to 1.6 cm) is also about 11%.

While the foregoing computations involve the waveguide aperture (which is more easily solved, as expressions for the electric and magnetic fields are easily derived), the foregoing can be extended by scaling the sizes of the ring of absorbing material and the horn aperture. This implies that the ring of absorber could be at least a few millimeters wide along the outer edge of the horn.

Figure 8:
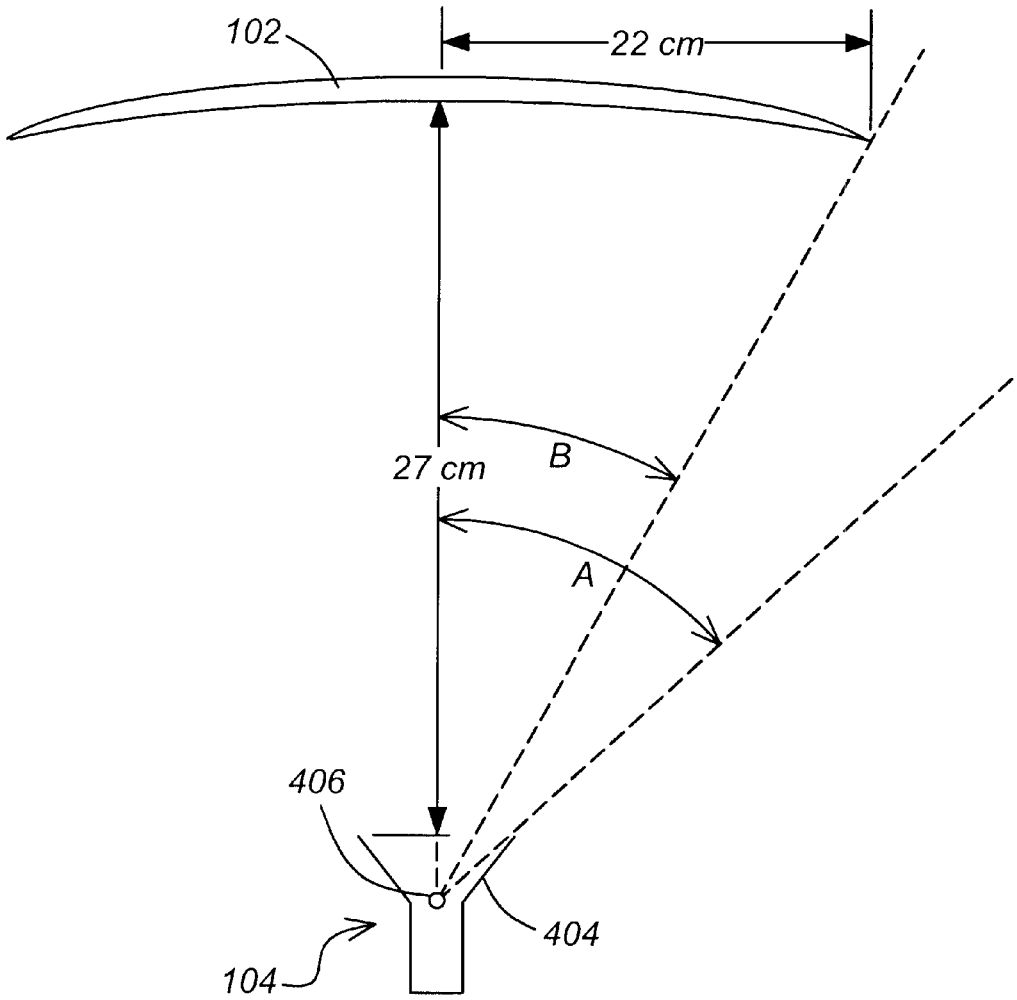
FIG. 8 is a diagram illustrating an approach to reduce the effect of spillover sidelobes.

Another simple scaling approach can be used in which the reduction in area of the horn aperture as seen by a ray entering the horn through the spillover sidelobe is used to estimate the reduction in the mainlobe sensitivity. For an angle of 60 degrees, the horn aperture area is $$Area_1=\pi\left[\left(\frac{diameter}{2}\right)^2\right][\cos(\phi)]^2$$

without the absorber ring, and $$Area_2=\pi\left[\left(\frac{diameter-0.6}{2}\right)^2\right][\cos(\phi)]^2$$

with the absorber ring, where ϕ is the angle between the feed assembly sensitive axis 306 and the direction of the ray (see for example, FIG. 8 and accompanying text below). With diameter=5 centimeters and ϕ=60 degrees, $Area_1$=4.9 $cm^2$ and $Area_2$=3.8 $cm^2$. This is an area reduction of about 22%.

Figure 9:
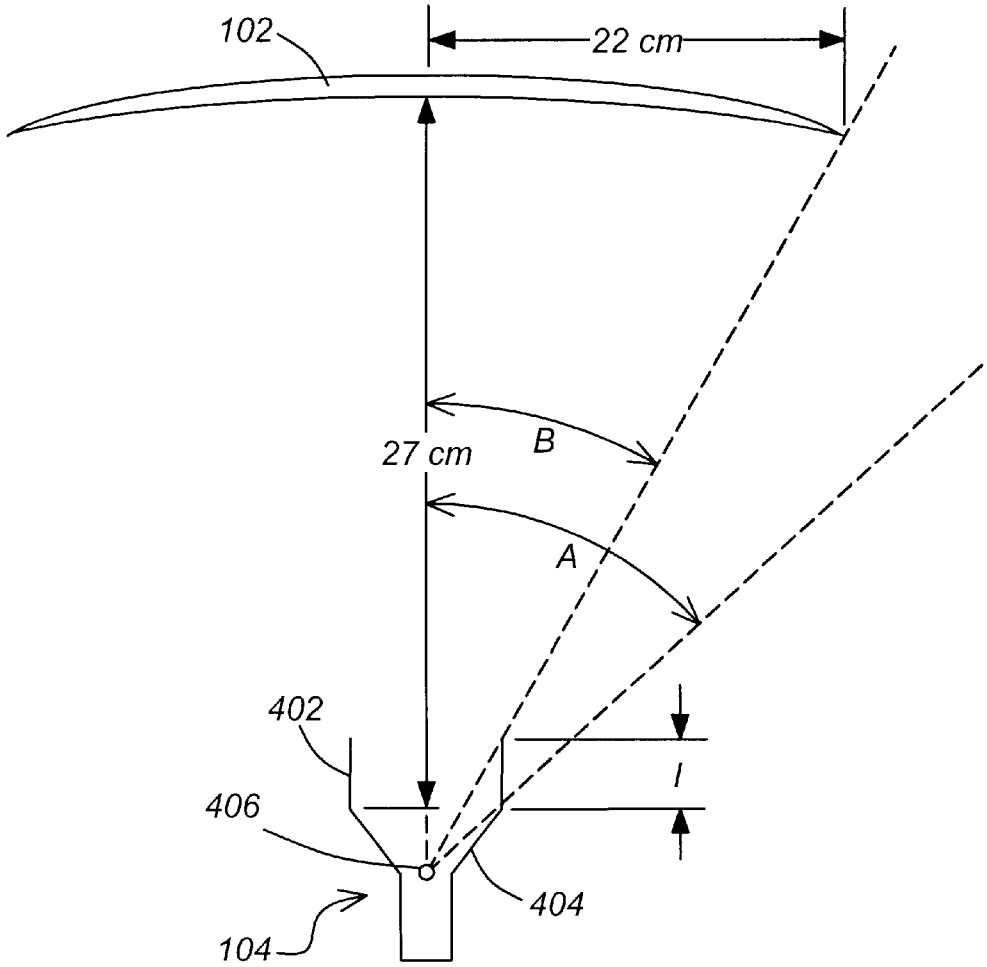
FIG. 9 is a diagram illustrating a further embodiment of the present invention.

Another approach can be used to reduce the effect of the spillover sidelobes. FIG. 9 is an illustration of the deployment of an absorber 402 that can be used to ameliorate the spillover energy of the antenna. Using the dimensions for the example shown in FIGS. 7 and 8, A=45 degrees and B=36.7 degrees. For this case, an absorber with a length of about 0.9 cm will block the spillover sidelobe from the center of the waveguide aperture. This configuration both reduces the spillover sidelobe while also minimally perturbing the antenna's main lobe radiation pattern. The spillover sidelobe is not reduced to zero, but a useful reduction in spillover sidelobe power is expected. Note that the length of the absorber 402 can be increased or decreased, depending on the precise geometry for the reflector and feed.

Figure 10:
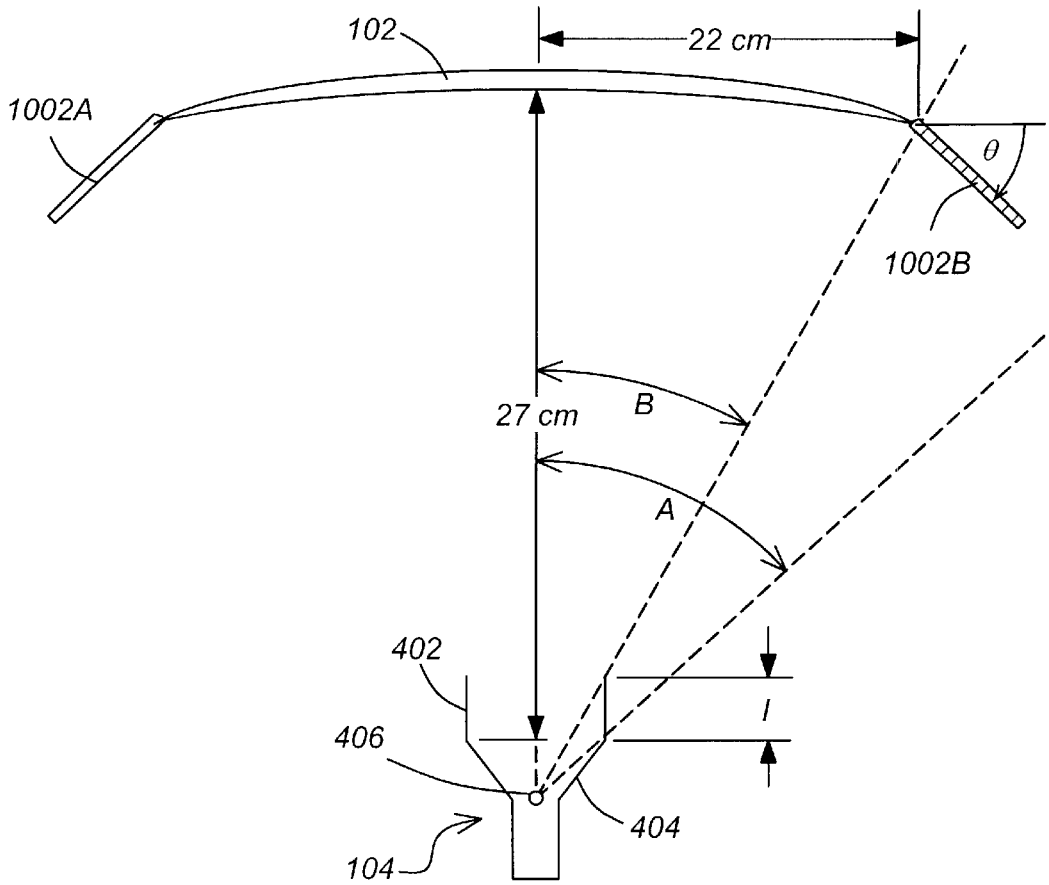
FIG. 10 is a diagram illustrating an embodiment utilizing a feed horn extension and absorbers coupled to the reflector.

FIG. 10 is a diagram illustrating another embodiment of the present invention. In this embodiment, elements 1002A and/or 1002B, which are substantially opaque to the electromagnetic energy are affixed to the reflector 102. Elements 1002A and/or 1002B can comprise material that either absorbs or reflects electromagnetic energy. Element(s) 1002A/1002B can be placed around the entire periphery of the reflector 102, or only in locations where required to block electromagnetic energy from the second (and interfering) transmitter. Elements 1002A/1002B can be placed at a variety of desired angles θ, including an angle which essentially extends the aperture of the antenna by extending the edge of the reflector 102. In one embodiment of the present invention, element 1002 is configured to allow attachment to the reflector, and can be bent to the proper angle as desired. This embodiment allows a technician or a customer to install the element 1002 and modify it as required to minimize spillover yet maintain mainlobe performance.

Those skilled in the art will recognize many modifications may be made to this configuration without departing from the scope of the present invention. For example, those skilled in the art will recognize that any combination of the above components, or any number of different components, peripherals, and other devices, may be used with the present invention.

Figure 11:
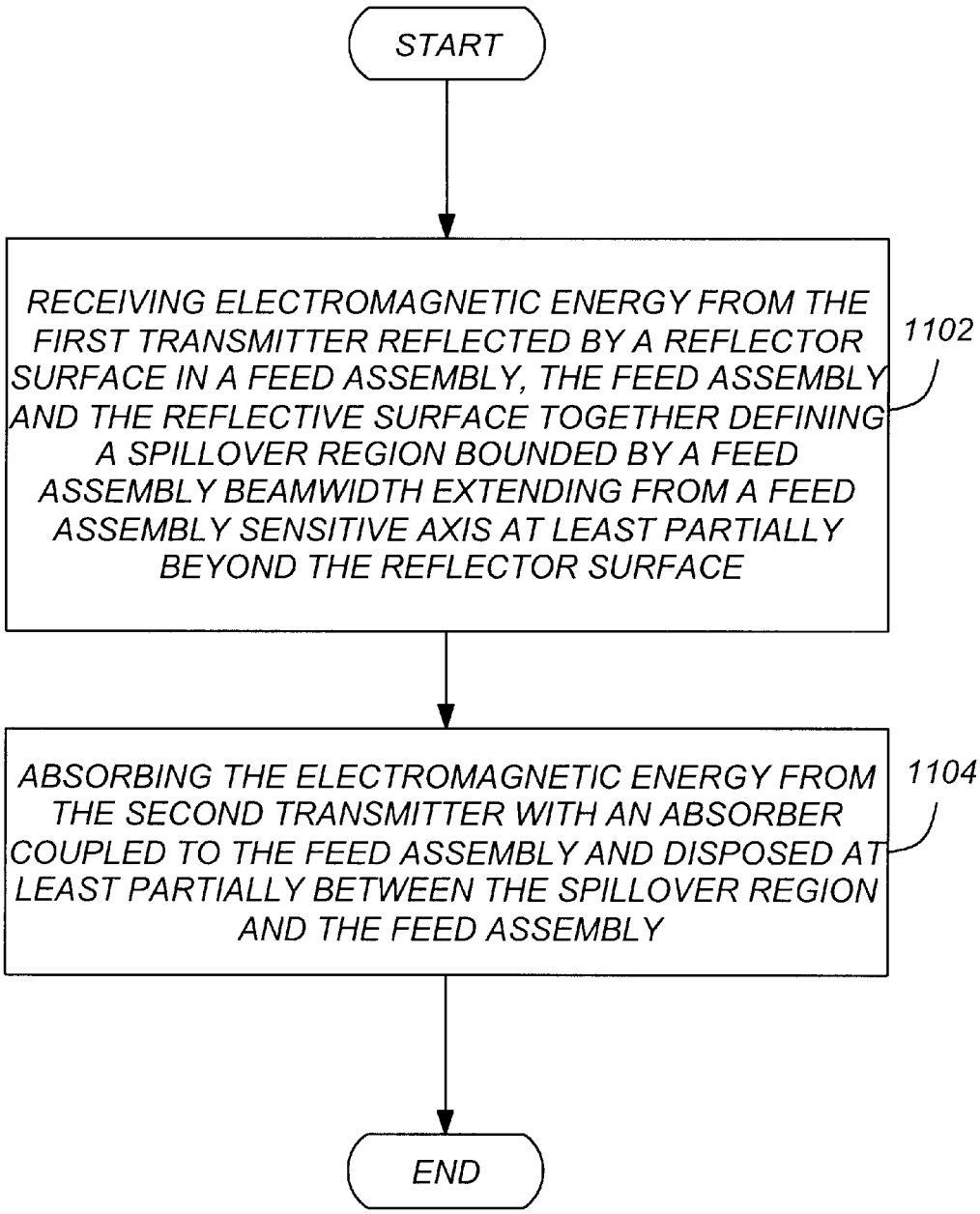
FIG. 11 is a diagram presenting illustrative operations that can be used to practice one embodiment of the present invention.

FIG. 11 is a flow chart presenting illustrative process steps that can be used to practice one embodiment of the present invention. In block 1102, electromagnetic energy is received from a first transmitter 110. The electromagnetic energy has been reflected by the reflector surface 410 to a feed assembly 104. The feed assembly 104 and the reflector surface 410 together define a spillover region 308 bounded by the beamwidth 304 extending from a feed assembly sensitive axis 306 to at least partially beyond the reflector surface 410. In block 1104, the electromagnetic energy is absorbed with an absorber 402 coupled at least partially between the spillover region 308 and the feed assembly 104.

Conclusion

The foregoing description of the preferred embodiment of the invention has been presented for the purposes of illustration and description. It is not intended to be exhaustive or to limit the invention to the precise form disclosed. Many modifications and variations are possible in light of the above teaching. For example, while the foregoing has been described with respect to an antenna having a reflector and a single feed assembly, the present invention may be practiced in embodiments using multiple feed assemblies.

It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An antenna for receiving electromagnetic energy from a first transmitter and substantially rejecting electromagnetic energy from a second transmitter spatially diverse from the first transmitter, comprising:

a reflector having a reflecting surface for reflecting and focusing the electromagnetic energy from the first transmitter to at least one focal point;

a feed assembly for receiving the reflected electromagnetic energy, the feed assembly having a sensitive axis facing the reflecting surface wherein the feed assembly and the reflector together define a spillover region bounded by a feed assembly beamwidth extending from the sensitive axis at least partially beyond the reflector surface; and an electromagnetic energy absorber, attached to the feed assembly and disposed at least partially between the spillover region and the feed assembly.

2. The apparatus of claim 1, wherein the feed assembly comprises a feed horn and the electromagnetic energy absorber is disposed on an inner surface of the feed horn.

3. The apparatus of claim 1, wherein the feed assembly comprises a feed horn having an outer periphery and the electromagnetic energy absorber is disposed on the outer periphery of the feed horn.

4. The apparatus of claim 3, wherein the electromagnetic energy absorber is disposed perpendicular to the sensitive axis.

5. The apparatus of claim 3, wherein the electromagnetic energy absorber is disposed parallel to the sensitive axis.

6. The apparatus of claim 3, wherein the electromagnetic energy absorber is disposed circumferentially about the feed assembly.

7. The apparatus of claim 1, wherein the absorber is disposed only between the second transmitter and the feed assembly.

8. The apparatus of claim 1, wherein the electromagnetic energy absorber is substantially opaque to electromagnetic energy at all incident angles.

9. The apparatus of claim 1, wherein the absorber is a cap removably attachable to the feed assembly having an electromagnetically absorbent material.

10. The apparatus of claim 1, further comprising:

a member, substantially opaque to the electromagnetic energy, attached to the reflector and disposed at least partially between the spillover region and the feed assembly.

11. The apparatus of claim 10, wherein the member is disposed only between the second transmitter and the feed assembly.

12. The apparatus of claim 10, wherein the member is formed of a material that substantially absorbs the electromagnetic energy.

13. The apparatus of claim 10, wherein the member is substantially opaque to electromagnetic energy at substantially all incident angles.

14. The apparatus of claim 10, wherein the member is disposed circumferentially about the reflector.

15. The apparatus of claim 10, wherein the member is removably attachable to the reflector.

16. An antenna for receiving electromagnetic energy from a first transmitter and substantially rejecting electromagnetic energy from a second transmitter spatially diverse from the first transmitter, comprising:

a reflector having a reflecting surface for reflecting and focusing the electromagnetic energy from the first transmitter to at least one focal point;

a receiving means for receiving the reflected electromagnetic energy, the receiving means disposed proximate the at least one focal point and having a sensitive axis facing the reflecting surface wherein the receiving means and the reflector together define a spillover region bounded by a receiving means beamwidth extending from the sensitive axis at least partially beyond the reflector surface; and an electromagnetic energy absorbing means, attached to the receiving means and disposed at least partially between the spillover region and the receiving means.

17. The apparatus of claim 16, wherein the receiving means comprises a feed horn and the absorbing means is disposed on an inner surface of the feed horn.

18. The apparatus of claim 16, wherein the receiving means comprises a feed horn having an outer periphery and the absorbing means is disposed on the outer periphery of the feed horn.

19. The apparatus of claim 18, wherein the absorbing means is disposed perpendicular to the sensitive axis.

20. The apparatus of claim 18, wherein the absorbing means is disposed parallel to the sensitive axis.

21. The apparatus of claim 18, wherein the absorbing means is disposed circumferentially about the feed assembly.

22. The apparatus of claim 16, wherein the absorbing means is disposed only between the second transmitter and the feed assembly.

23. The apparatus of claim 17, wherein the absorbing means is substantially opaque to electromagnetic energy at all incident angles.

24. The apparatus of claim 16, wherein the absorbing means is a cap removably attachable to the feed assembly having a electromagnetically absorbent material.

25. A method of receiving electromagnetic energy from a first transmitter and substantially rejecting electromagnetic energy from a second transmitter spatially diverse from the first transmitter, comprising the steps of:

receiving electromagnetic energy from the first transmitter reflected by a reflector surface in a feed assembly, the feed assembly and reflective surface together defining a spillover region defined by a feed assembly beamwidth extending from a feed assembly sensitive axis at least partially beyond the reflector surface; and absorbing the electromagnetic energy from the second transmitter with an absorber coupled to the feed assembly and disposed at least partially between the spillover region and the feed assembly.

26. The method of claim 25, wherein the feed assembly comprises a feed horn and the absorber is disposed on an inner surface of the feed horn.

27. The method of claim 25, wherein the feed assembly comprises a feed horn having an outer periphery and the absorber is disposed on the outer periphery of the feed horn.

28. The method of claim 27, wherein the absorber is disposed perpendicular to the sensitive axis.

29. The method of claim 27, wherein the absorber is disposed parallel to the sensitive axis.

30. The method of claim 27, wherein the absorber is disposed circumferentially about the feed assembly.

31. The method of claim 25, wherein the absorber is disposed only between the second transmitter and the feed assembly.

32. The method of claim 25, wherein the absorber is substantially opaque to electromagnetic energy at all incident angles.

33. The method of claim 25, wherein the absorber is removably attachable to the feed assembly.

34. An antenna for receiving electromagnetic energy, comprising:

an reflector;

a feed assembly for receiving electromagnetic energy reflected by the reflector;

wherein the antenna includes a gain characteristic having posterior-side lobes formed by a feed assembly beamwidth extending from the feed assembly sensitive axis beyond the reflecting surface; and an electromagnetic energy absorber, attached to the feed assembly, for attenuating the electromagnetic energy received via the posterior side lobes.

35. An antenna for receiving electromagnetic energy from a first transmitter on a first side of the antenna and substantially rejecting electromagnetic energy from a second transmitter on a second side of the antenna, comprising:

a reflector having a reflecting surface for reflecting and focusing the electromagnetic energy from the first transmitter;

a feed assembly for receiving the reflected and focused electromagnetic energy, the feed assembly having a sensitive axis facing the reflecting surface;

wherein the feed assembly and the reflector together define a spillover region in which the feed assembly is exposed to electromagnetic energy from the second transmitter disposed on the second side of the reflector; and an electromagnetic energy absorber, attached to the feed assembly, the absorber for attenuating electromagnetic energy from the second transmitter in the spillover region.

36. The antenna of claim 35, wherein the first transmitter is a satellite and the second transmitter is a terrestrially-based transmitter.

* * * * *